US006187244B1

(12) United States Patent
Fishel et al.

(10) Patent No.: US 6,187,244 B1
(45) **Date of Patent: *Feb. 13, 2001**

(54) METHOD OF MAKING AN EMBOSSED, WATERPROOF SHOWER PAN LINER

(75) Inventors: David L. Fishel, Caledonia, MS (US); Peter F. Payne, Irwin, PA (US)

(73) Assignee: Omnova Services Inc., Fairlawn, OH (US)

( * ) Notice: Under 35 U.S.C. 154(b), the term of this patent shall be extended for 0 days.

This patent is subject to a terminal disclaimer.

(21) Appl. No.: 09/246,493

(22) Filed: Feb. 9, 1999

Related U.S. Application Data

(62) Division of application No. 08/744,343, filed on Nov. 7, 1996, now Pat. No. 5,914,173.

(51) Int. Cl.[7] ..... B29C 43/24; B29C 59/02; B29C 59/04

(52) U.S. Cl. ..... 264/293; 264/175; 264/210.1; 264/284; 428/156

(58) Field of Search ..... 264/293, 294, 264/175, 296, 322, 210.1, 284; 428/156, 187, 192, 332; 4/612, 596, 695, 615; 5/417

(56) References Cited

U.S. PATENT DOCUMENTS

| | | | | |
|---|---|---|---|---|
| 3,130,412 | | 4/1964 | Fox et al. . | |
| 3,798,294 | * | 3/1974 | Hollenbeck | 264/175 |
| 3,956,450 | | 5/1976 | Abe et al. | 264/210.1 |
| 4,062,918 | | 12/1977 | Nakanose | 264/132 |
| 4,067,071 | * | 1/1978 | Altman | 4/145 |
| 4,612,152 | * | 9/1986 | Kawabata et al. | 264/136 |
| 4,650,082 | | 3/1987 | Paciorek | 215/230 |
| 4,785,045 | * | 11/1988 | Yonekura et al. | 524/528 |
| 4,897,293 | * | 1/1990 | Thessen | 428/40 |
| 5,078,931 | * | 1/1992 | Yanagihara et al. | 264/41 |
| 5,133,707 | | 7/1992 | Rogers et al. | 604/389 |
| 5,191,007 | * | 3/1993 | Zelazny et al. | 524/336 |
| 5,258,217 | | 11/1993 | Lewis | 428/120 |
| 5,371,980 | * | 12/1994 | Dix | 52/34 |
| 5,384,177 | * | 1/1995 | Rissmann | 428/182 |
| 5,693,405 | | 12/1997 | Harvie et al. | 428/156 |

* cited by examiner

*Primary Examiner*—Jan H. Silbaugh
*Assistant Examiner*—Michael I. Poe
(74) *Attorney, Agent, or Firm*—Robert F. Rywalski; Daniel J. Hudak

(57) ABSTRACT

A method for making a flexible, waterproof shower pan liner comprised of a water-insoluble thermoplastic sheet. The shower pan liner includes on at least one surface selected indicia such as product information or plumbing codes at regular intervals. The indicia are embossed into the shower pan liner thereby eliminating the need for a protective top coat. In the process for making the invention, the thermoplastic is heated, calendered, and thereafter embossed with the selected indicia while in a heated condition.

5 Claims, 1 Drawing Sheet

METHOD OF MAKING AN EMBOSSED, WATERPROOF SHOWER PAN LINER

CROSS-REFERENCE

This is a divisional application of Ser. No. 08/744,343, filed on Nov. 7, 1996, now U.S. Pat. No. 5,914,173, of David L. Fishel, et al., for EMBOSSED, WATERPROOF LINING AND METHOD OF MAKING THE SAME.

FIELD OF THE INVENTION

The present invention relates generally to waterproof linings for use in the construction industry and more particularly to waterproof shower pan liners having embossed indicia such as plumbing requirements and code specifications. Further, the invention relates to a method for making the shower pan liner.

BACKGROUND OF THE INVENTION

Waterproof linings are used in the construction industry for various applications. For example, the liner can be used as a barrier layer to prolong the durability of a substrate by protecting it from deterioration due to moisture. An example of such a liner is a shower pan liner which is generally in the form of a roll and is utilized in an industrial plant shower wherein parallel sheets of the liner are overlapped at their edges.

It is particularly advantageous to include indicia on the shower pan liner. Such indicia could include, for example, information with respect to plumbing codes, building codes, physical test data, or quality assurance. Warnings and/or other installation information could likewise be included.

Heretofore, the liner has been generally produced by calendering a thermoplastic and printing the indicia thereon. A top coat such as an acrylic has been added thereto to protect the printing. However, process disadvantages include the requirement of additional processing steps and materials. Moreover, during storage as in hot warehouses, the coating material would often adhere to the top surface of an adjacent layer and have a tendency of removing the printing upon separation of the layers.

SUMMARY OF THE INVENTION

The invention relates to a waterproof, thermoplastic shower pan liner which has embossed indicia therein such as plumbing code and quality standard symbols. The invention provides necessary indicia without the need for an additional top coat, thereby eliminating the need for an additional processing step.

Another object of the invention is to provide a method of making a waterproof lining comprising the steps of heating, and calendering a water-insoluble, thermoplastic polymer, and thereafter embossing said thermoplastic while in a heated and/or soft condition with selected indicia so as to form an article substantially free of a protective top coat.

DETAILED DESCRIPTION OF THE INVENTION

Figure 1:
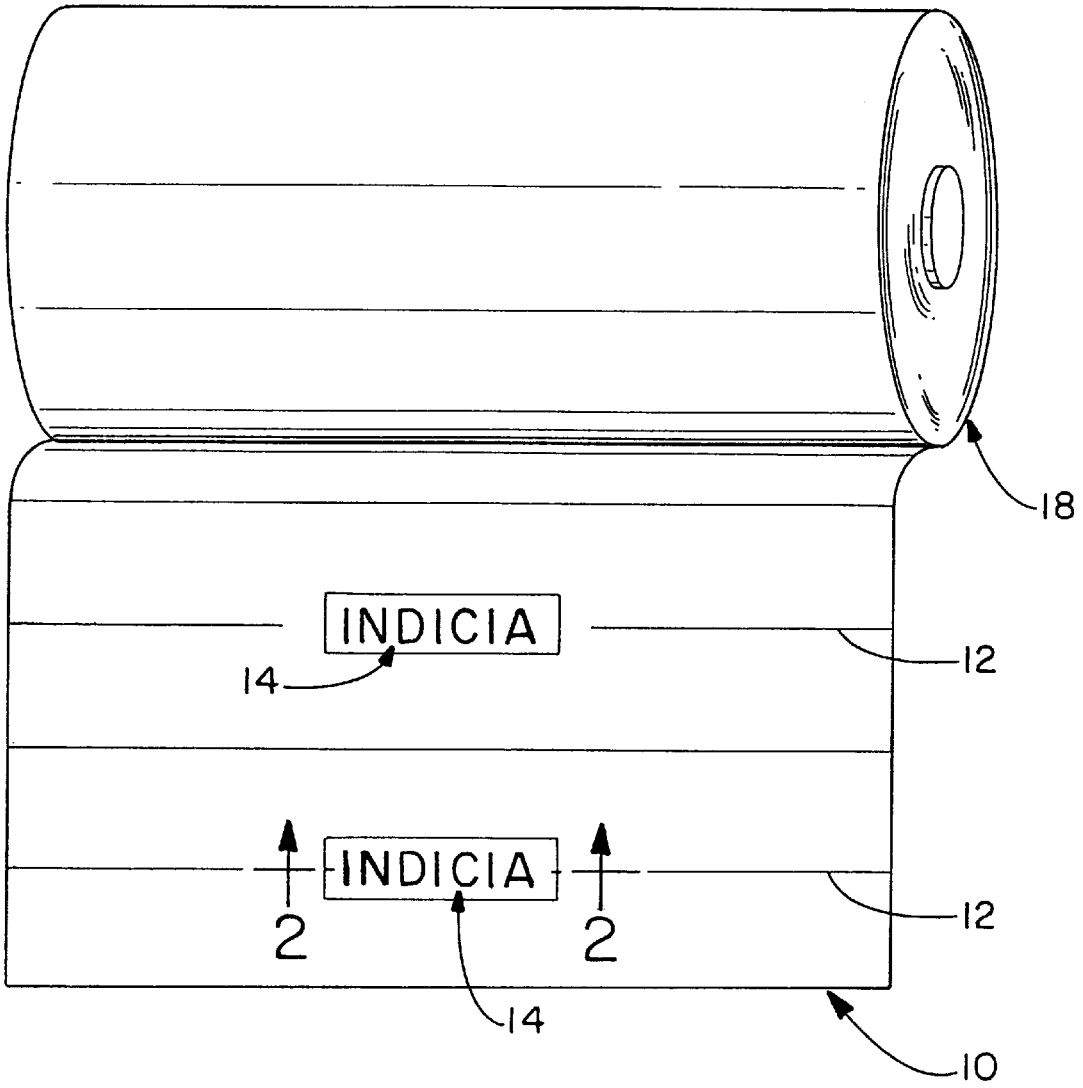
FIG. 1 is a perspective view showing a roll of the shower liner material of the present invention with indicia thereon.
Figure 2:
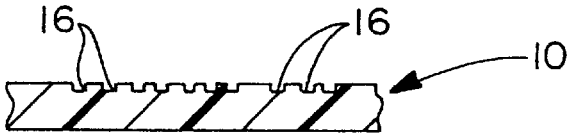
FIG. 2 is a cross-sectional view of the shower pan liner taken at line 2—2 of FIG. 1.

A shower pan liner is shown in FIG. 1 and is generally indicated by the numeral 10. The liner is made from a flexible thermoplastic water-proof polymer. Suitable polymers include polyolefins such as polymerized vinyl chloride or vinylidene chloride monomers with plasticized PVC being preferred wherein the amount of plasticizer is generally from about 45 to about 75 parts by weight and preferably from about 55 to about 65 parts by weight per 100 parts by weight of PVC. Non-plasticized PVC is generally not utilized inasmuch as it is rigid, and hence, not flexible. Other thermoplastic olefins include those derived from monomers containing from 2 to 4 carbon atoms with examples including polyethylene, low density polyethylene, polypropylene, as well as halogenated polyolefins such as chlorinated polyethylene, and the like. Since the liner material is flexible, as shown in FIG. 1, it is often produced and stored in the form of a roll. The thickness of the liner is generally sufficient to form a suitable water-proof membrane for use in the construction and building industry with a preferred end use being a liner for an industrial shower as in a factory, gymnasium, or as a liner beneath a home bath tub or shower stall. Suitable thicknesses generally range from about 15 to about 80 mils, desirably from about 20 to about 60 mils, and preferably from about 25 to about 45 mils. As shown in FIG. 1, the roll of the shower pan liner in the form a long continuous sheet has embossed lines 12 therein desirably at spaced intervals of any desired length such as 6 inches, a foot, etc. Lines 12 are substantially perpendicular (i.e., form an angle of from about 80 to about 100 degrees and preferably about 90 degrees) with respect to the length of the roll. Embossed lines 12 can be continuous or discontinuous as shown and preferably are embossed on the top surface as shown in FIG. 1. By term "embossed" it is meant that a depression, a groove, a recess or an indentation, is made in the surface of the liner. The depth of the embossment is not important so long as it is visually apparent. Typical embossment depths can range from about 1 or 2 to about 15 mils, with a suitable depth often being about 3 to about 5 or 6 mils. As shown in FIG. 2, the embossed indicia 14, as more fully discussed hereinbelow, is squared-off at the bottom 16 thereof.

An important aspect of the present invention is that the liner contain embossed indicia 14 thereon such as product information, building code information, installation information, and the like. With regard to the preferred end use of a shower pan liner, it preferably contains embossments with regard to different plumbing codes, test data, minimum quality certification, and the like. The shower pan liner can include any number of different embossments 14 such as 4 or 5, and the same are generally repeated throughout the length of the liner. The plumbing code, quality assurance symbol, etc., embossments can be located on either the top or the bottom side of the liner sheet.

Although the shower pan liner can be made of numerous sizes and shapes, desirably it is in the form of a roll 18. The process for forming the roll can vary but generally the thermoplastic such as the preferred polyvinyl chloride is added to a Banbury in sufficient amounts along with plasticizer and other additives such as processing aids and the like, and compounded. The mixture is then dropped into a holding mill, for example, a two roll mill, and then fed to an extruder. It is then extruded onto a four roll inverted "L" calender and calendered into a sheet of a suitable width such as 4, 5, or 6 feet. Within a suitable distance from the calender so that only a slight cooling occurs, the calendered sheet is fed between an embossing nip roll and a rubber backing roll. The embossing roll is generally made out of metal and has desired indicia thereon, such as plumbing codes, quality assurance codes, embossing lines, and the like. From these set of rolls the thermoplastic liner is fed to cooling rolls and subsequently coiled into a roll.

The shower pan liner is then used as produced. That is, there is no need for printing any verbiage, indicia, or logo thereon and the liner is preferably completely free of any such printed matter. Similarly, the need for a top layer which would protect the printed indicia is also eliminated and thus the shower pan liner is subsequently free of any top coat and preferably completely free thereof. By the term "substantially free of any top coat," it is meant that generally less than ½ or ¼, and desirably less than 1/10 ounce per square yard of a top coat, e.g., a protective polymer, exists on the liner. Shrinkage or stretching of the liner has also generally been abated or eliminated inasmuch as heretofore the existence and application of a top layer has generally caused shrinkage of the liner. That is, heretofore, the application of a top coat has resulted in inconsistency of the perpendicular spacing lines along the length of the sheet. So prevalent was this problem that installers typically did not use the lines, but rather measured the distance. In contrast, the present invention shrinks very little and installers can use the embossed perpendicular spacing lines. This is because any shrinkage or stretching of the spaced lines after they are applied by the nip roll on the warm calender sheet when compared to the distance of the lines on the sheet at room temperature, e.g., room temperature snap back, is generally 5 percent or less, and preferably 3 percent or less. Hence, the liners of the present invention have high dimensional shrink or stretch stability.

The shower pan liners of the present invention can be installed as a water-proof liner with respect to any shower facility. In large industrial showers as in factories, gymnasiums, and the like, the flexible embossed water-proof thermoplastic shower liner is laid over the substrate material such as concrete. A portion of the liner sheet is laid against any upstanding or vertical wall at the end of the shower area so that a lip is formed. To the remaining edge of the liner sheet, an adhesive or glue is applied and a second sheet applied parallel to the first. This procedure is repeated generally until the lowest most point of the shower is reached. Then the entire immediately above-noted procedure is repeated on the other side of the shower until the entire shower facility floor is lined and completely covered with the liner of the present invention. A hole in the liner can then be made over the drain. Ceramic tiles and mortar can be applied over the liner of the present invention. Of course, other flooring can be utilized such as concrete or thick mortar. Should the tile, mortar or concrete crack or break, the shower pan liner acts as a water-proof barrier to prevent the water from reaching the concrete substrate. In a home application, a shower pan liner is generally laid over a wood base with the bathtub or fiberglass shower stall, etc., placed there over.

In addition to as functioning as a liner with regard to a shower facility, the liner material of the present invention can be used in other building or construction sites whereever a water-proof barrier over a concrete substrate, etc., is desired.

While in accordance with the patent statutes the best mode and preferred embodiment has been set forth, the scope of the invention is not limited thereto, but rather by the scope of the attached claims.

What is claimed is:

1. A process for forming a water-proof shower pan liner, comprising;

forming a flexible water-proof thermoplastic polymer liner for a shower pan having a top surface and bottom surface; and embossing said thermoplastic polymer liner on only one of said surfaces with embossed construction industry information indicia and substantially spaced embossed lines perpendicular to the liner edge.

2. A process for forming a water-proof shower pan liner according to claim 1, wherein said thermoplastic polymer is a polyolefin or a halogenated polyolefin derived from monomers containing from 2 to 4 carbon atoms, plasticized polyvinylchloride, polyvinylidene chloride, or blends thereof.

3. A process for forming a water-proof shower pan liner according to claim 2, wherein said at least one construction industry information indicia is a plumbing code.

4. A process for forming a water-proof shower pan liner according to claim 3, wherein said liner is substantially free of a protective top coating.

5. A process for forming a water-proof shower pan liner according to claim 4, wherein said thermoplastic liner has a thickness of from about 15 to about 80 mils, and wherein said thermoplastic liner is plasticized PVC.

* * * * *